US005632421A

United States Patent [19]

Colombo

[11] Patent Number: 5,632,421

[45] Date of Patent: May 27, 1997

[54] AEROSOL METERING VALVES

[75] Inventor: Adriano Colombo, Vercurago, Italy

[73] Assignee: Rexam Dispenser S.p.A., Olginate, Italy

[21] Appl. No.: 498,672

[22] Filed: Jul. 3, 1995

[30] Foreign Application Priority Data

Jul. 14, 1994 [GB] United Kingdom ..... 9414236

[51] Int. Cl.[6] ..... B65D 83/14

[52] U.S. Cl. ..... 222/402.2

[58] Field of Search ..... 222/402.16, 402.19, 222/402.1, 402.2, 402.24

[56] References Cited

U.S. PATENT DOCUMENTS

| | | | |
|---|---|---|---|
| 3,605,738 | 9/1971 | Ciranna | 222/402.2 |
| 4,842,168 | 6/1989 | Bougamont et al. | 222/402.2 |
| 5,169,038 | 12/1992 | Di Giovanni | 222/402.2 |

FOREIGN PATENT DOCUMENTS

| | | | |
|---|---|---|---|
| 2206100 | 10/1988 | United Kingdom . | |
| 2206099 | 12/1988 | United Kingdom | 222/402.2 |
| 2206860 | 1/1989 | United Kingdom . | |

*Primary Examiner*—Philippe Derakshani

*Attorney, Agent, or Firm*—Hoffman, Wasson & Gitler, P.C.

[57] ABSTRACT

A metering valve for liquids to be dispensed in doses of fixed amount has a metering chamber of fixed volume which is intended to be filled with the liquid when the container is inverted and the operating valve is partially opened. After the metering chamber has had its contents discharged by the valve being fully opened, and the valve member is released to return to its valve-closed position, the chamber refills under gravity. When the container is replaced in its upright position, liquid is prevented from flowing back into the container by an effective one-way valve. This may be provided by an O-ring or similar mechanical barrier to flow, or the flow passage may be dimensioned so that capillary forces prevent gravity being able to allow gas or vapor in the ullage space to displace the liquid in the metering chamber. By these structures the container remains capable of dispensing the desired fixed amount of liquid immediately after it is inverted and the operating member is operated.

4 Claims, 11 Drawing Sheets

AEROSOL METERING VALVES

BACKGROUND OF THE INVENTION

This invention relates to aerosol metering valves, by which term is meant a valve intended to be secured in a fluid-tight manner to a container for a pressurized liquid intended to be dispensed in fixed amounts per dispensation.

The liquid to be dispensed (product) may be a liquefied gas generating sufficient vapor pressure to dispense itself when the valve is opened. Liquids which are not this volatile may have a fluid propellant added to them. When the vapor pressure drops, sufficient of the propellant boils off to provide additional vapor, so that the discharge pressure is kept virtually constant irrespective of the amount of product in the container. The product may be only a liquid, but when the container is intended to dispense controlled amounts of a medicament, the latter may take the form of a powered solid which is suspended in the liquid carrier, or dissolved in it. Such solutions or suspensions are included in the term 'liquid product' or just simply 'product'.

In order to avoid the need for a dip tube to convey product up to the valve so that the product may be dispensed when the container is upright, with the valve on top, known containers are intended to be turned upside-down before the valve is opened. This ensures that only liquid product passes through the valve until the product is almost exhausted, at which stage some gas is discharged with the liquid.

When the container is turned upright after a dispensation, the liquid product in a constant-volume (metering) chamber forming part of the valve tends to drain back into the container, being replaced by the propellant gas or vapor. Thus when the container is next inverted for a fixed volume of product to be dispensed, opening the valve has to be deferred for a period sufficient to permit all the gas in the metering chamber to be replaced by liquid. In addition, if the product to be dispensed is a suspension, while the carrier liquid may drain back, the suspended particles would tend to be trapped in the passages leading from the metering chamber. This is highly undesirable, because when a fresh charge of product enters the metering chamber, it has the residual particles suspended in it, so that its concentration varies, and the user loses control of the amount of medicament dispensed during each operation. If the time allowed for recharging is insufficient, the chamber contains a mixture of liquid and gas at the time the valve is opened, so that less than the predetermined volume of liquid is dispensed.

In order to fill the container after the metering valve has been secured to the open mouth of the container by crimping, fresh product is introduced via a passage under such pressure that a sealing gasket is flexed sufficiently to break the fluid seal between it the and an operating rod. When this filling pressure is removed, the gasket resiles into its sealing position. This being already known, it will not be further described herein.

The present invention aims at providing an aerosol metering valve containing a fixed-volume metering chamber out of which liquid product cannot drain under gravity when a container to which the valve is sealed is upright.

SUMMARY OF THE INVENTION

Accordingly the present invention provides a metering valve for an aerosol container to which the valve is to be sealed in a fluid-tight manner, comprising: a metering chamber of fixed volume through which extends a valve rod in fluid-tight sealing engagement with two spaced-apart gaskets; a spring seat member movable with the valve rod and engaged by a biasing spring; a valve body having part thereof circumscribing the spring seat member when in its valve-closed position, with the valve body and the spring seat member forming an annular passage through which liquid product to be dispensed may flow en route to the metering chamber, and means for preventing the flow of liquid in the reverse direction under gravity.

In one embodiment of the present invention, the reverse flow preventer consists of at least the annular passage being so narrow that it forms a capillary passage which is able to hold liquid in the metering chamber by surface tension.

In an alternative embodiment, the annular passage is blocked by an O-ring or like annular seal engaging the cylindrical surface of the spring seat member when in its valve-closed position.

BRIEF DESCRIPTION OF THE DRAWINGS

The present invention will now be described by way of example with reference to the accompanying drawings, in which.

In all the drawings, those parts which are identical in the different view retain the same references.

DETAILED DESCRIPTION OF THE INVENTION

Figure 1:
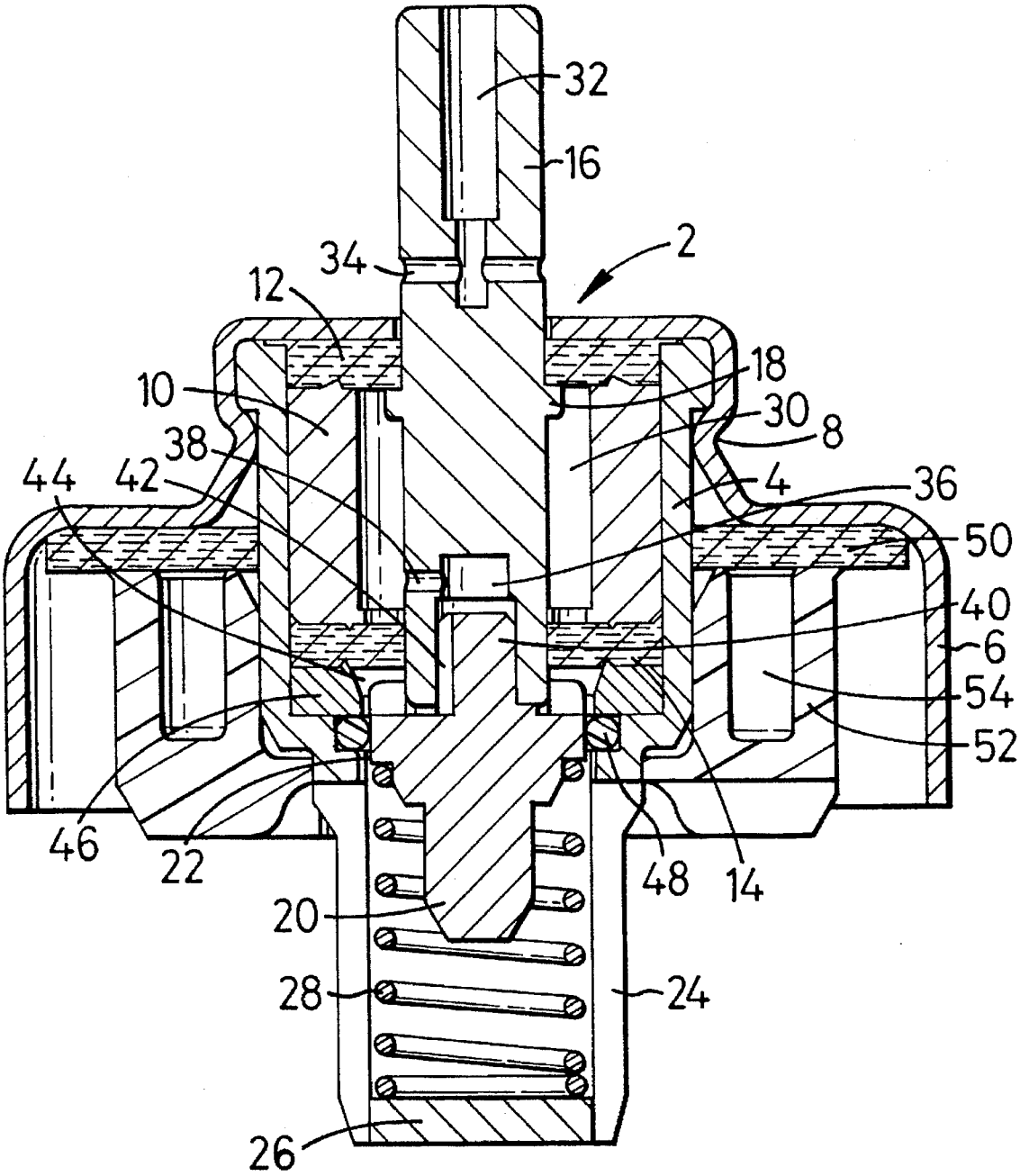
FIG. 1 is a sectional view of one form of metering valve of the present invention.

In the valve 2 shown in FIG. 1, the valve body 4 has a mounting flange 6 secured to it by a circular crimp 8. Positioned inside the body 4 is a hollow cylindrical sleeve 10 of known radial thickness. The sleeve extends between two axially-spaced gaskets 12 and 14. Slidably mounted in the gaskets is a valve rod 16. This has a flange 18 which limits its outward movement of the rod. At its other end, the rod is attached to a spring seat member 20 having a cylindrical sealing surface 22. An extension 24 from the body carries a fixed spring seat 26. Extending between the two seats is a helical compression spring 28 biasing the valve rod outwardly.

The sleeve 10, gaskets and valve rod define between them a fixed-volume metering chamber 30. The actual volume of the chamber can be chosen when the valve is being manufactured, by using a sleeve with the appropriate wall thickness.

The valve rod has in its outer end an axial passage 32 intersected by at least one radial passage 34. When the rod has been depressed sufficiently, against the bias of spring 28, the chamber 30 is able to vent its contents through passages 34 and 32. At its inner end, the rod is formed with a chamber 36 which receives part 40 of the spring seat member 20 to hold the two components together. The chamber is intersected by a radial passage 38. The part 40 has a longitudinal passage 42, so that the passages cooperate to place the metering chamber in communication with a space 44 defined by an annular packing ring 46. This space is prevented from communicating with the interior of the container (see FIG. 2) to which the valve is secured, by an O-ring 48 which is kept in place in a rebate in the body by means of the ring 46. The O-ring 48 is in sealing engagement with the surface 22 of the spring seat 20.

The flange 6 is in sealing engagement with a gasket 50 which is held in place by means of a guide member 52 of plastics material secured to body 4. The guide has in it spaces 54 giving it a measure of resilience.

Figure 2:
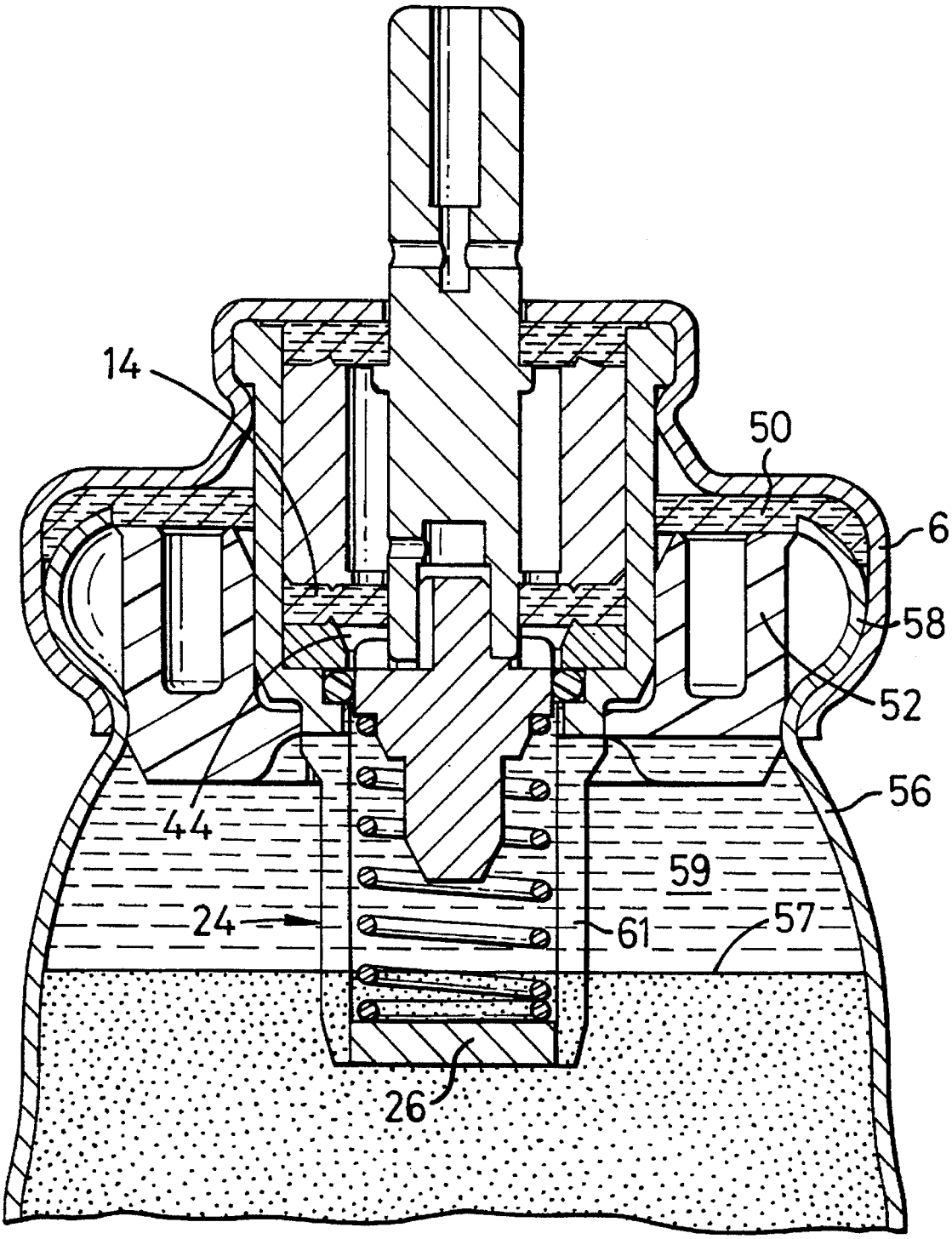
FIG. 2 is a sectional view of the valve of FIG. 1 in position on a container of liquid product.
Figure 8:
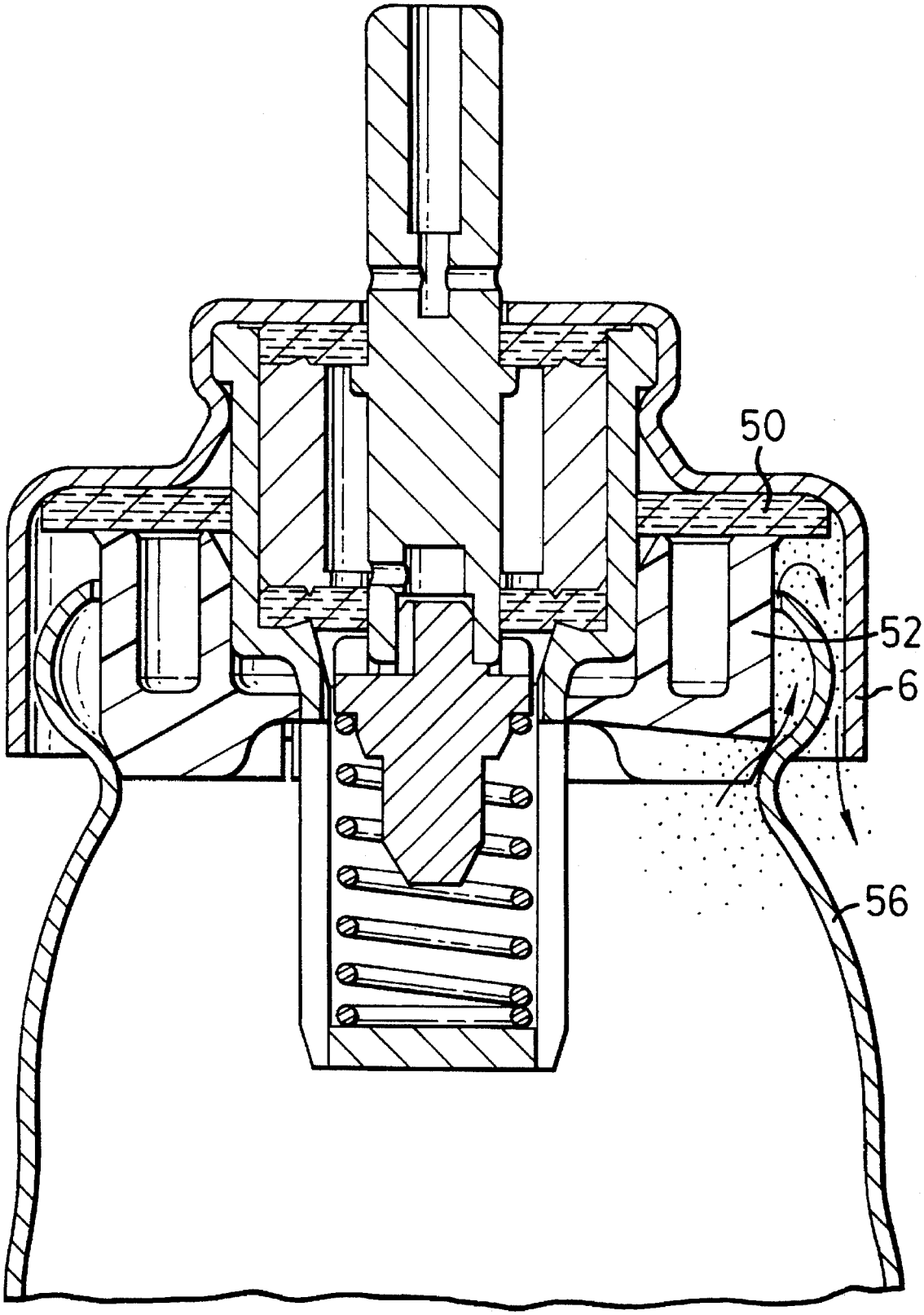
FIG. 8 is a sectional view of the valve of FIG. 7 being positioned on the neck of a container of product to be dispensed.

As can be seen from FIG. 2, the valve 2 is secured in fluid-tight manner to a container (can) 56 having an open mouth with a rounded rim 58. After the can has been pushed into the flange 6 with sufficient force to generate a seal with gasket 50 and guide 52, the flange is crimped to grip the rim so as to maintain the seal. Usually air is purged from the container while it is held only loosely in contact with the cap, as is shown in FIG. 8. In known fashion, the purging may be done by admitting a small quantity of a volatile liquid into the can, and allowing the liquid to vaporise and dispel air from within the can. When the interior of the can is virtually all filled with the vapor, the crimping operation is finished to seal the interior of the can from the atmosphere. After this has been done the can is charged with the liquid to be dispensed. This is usually done by partially depressing the operating rod until the passages 34 open into the metering chamber 30. The liquid product to be dispensed is introduced into passage 32 under such pressure that the gasket 14 is forced to flex away from the outside surface of the rod 16 sufficiently to allow the product to flow into the interior of the container 56, bypassing the passage 42. When the container has been filled, and before any product has been dispensed from it, the surface of the product reaches the line 57, so that the metering valve is usually in the ullage space 59, so that only propellant would be discharged if the valve were opened with the can upright. In order to discharge a fixed volume of the liquid product, it is first necessary to invert the can.

Starting from this position, the rod is pushed inwardly against the bias. This first moves the surface 22 out of sealing engagement with the O-ring 48, permitting the gaseous contents of the metering chamber to be displaced by liquid product, by way of space 44, passage 42, chamber 36 and passage 38. Product is able to flow into the annular space 44 through longitudinal gaps 61 between the fingers forming extension 24. Continuing movement causes the passage 38 to be blocked, against the further flow of product, by the inner gasket 14. Further movement of the rod finally brings the metering chamber into communication with passages 34 and 32, permitting the contents of the chamber to be discharged under the influence of the pressure of the contents. Discharge ceases when the pressure of chamber 30 falls to atmospheric, resulting in a fixed volume of product passing along passage 32 for each operation of rod 16.

Figure 3:
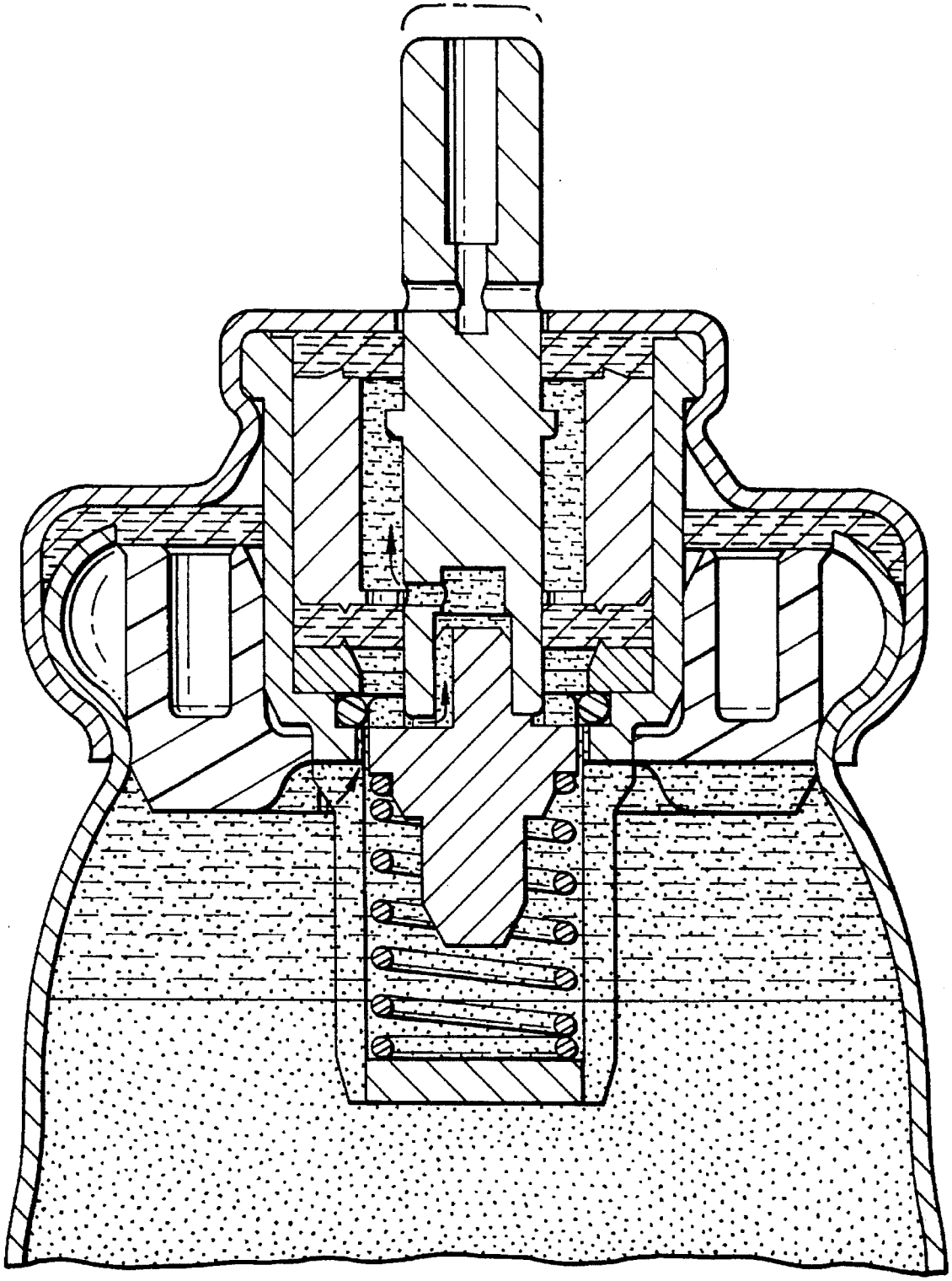
FIG. 3 is a view similar to FIG. 2 showing the valve in a partially-open position.
Figure 4:
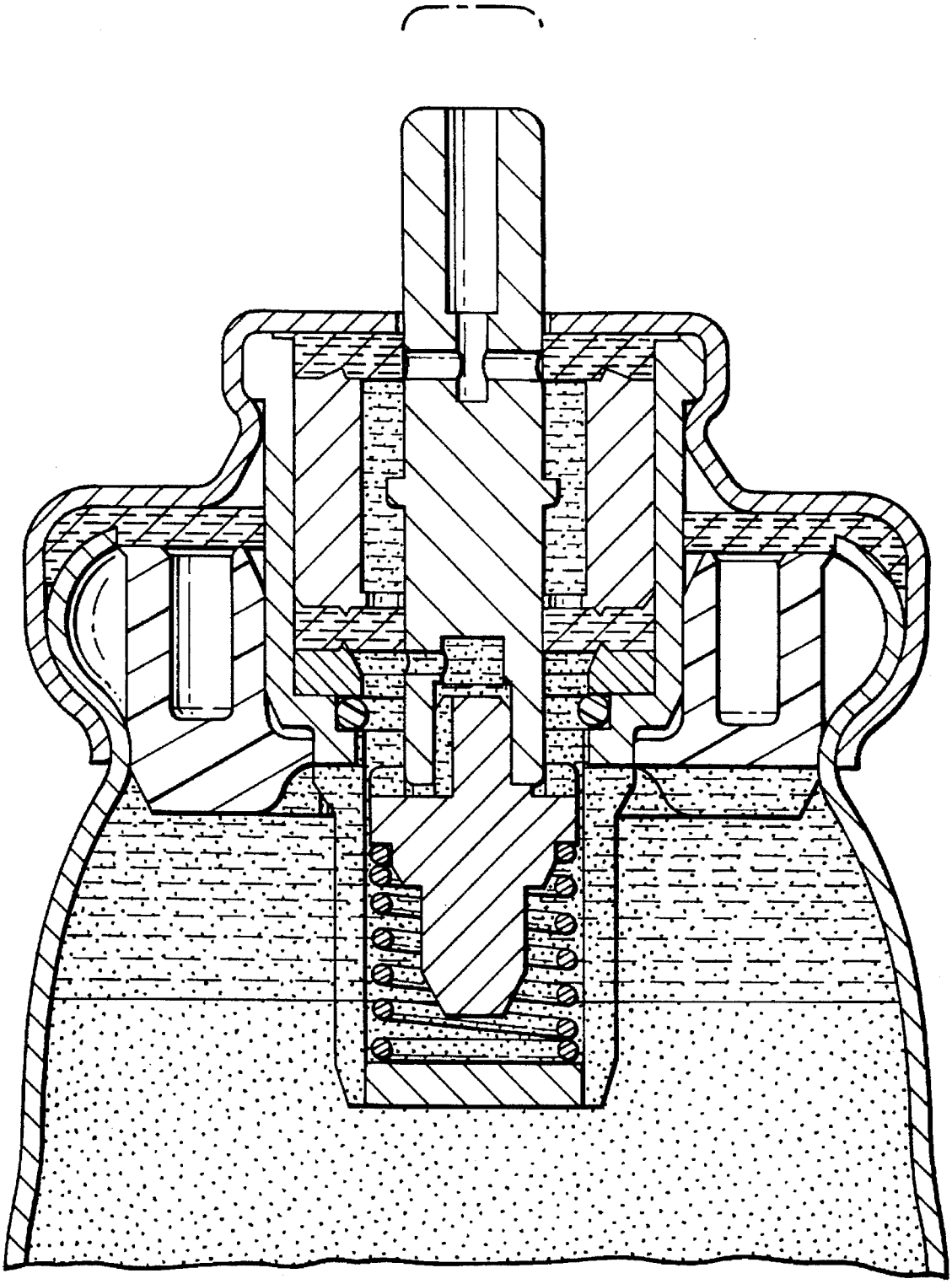
FIG. 4 is a view similar to FIG. 3 with the valve open more.
Figure 5:
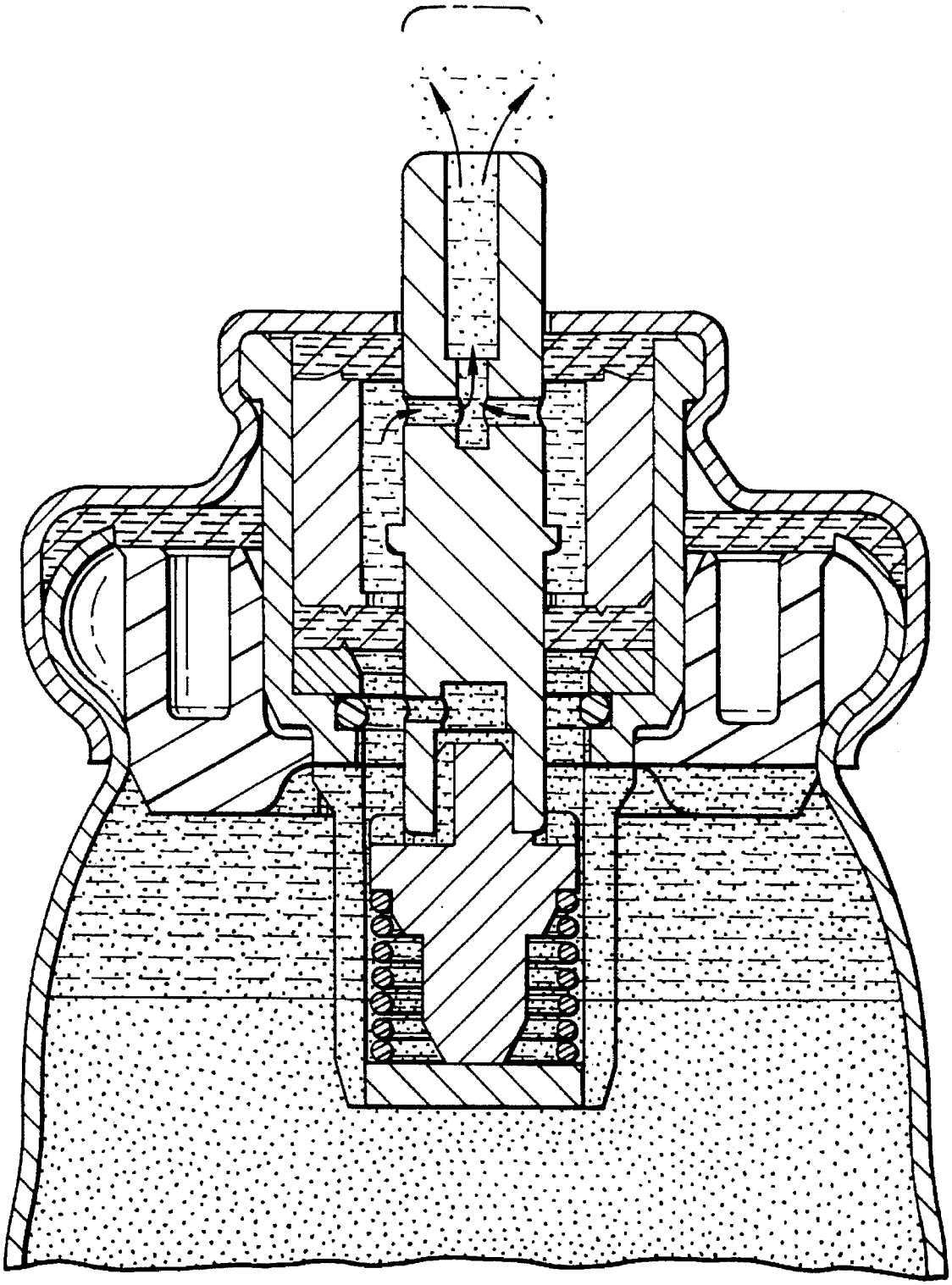
FIG. 5 is a view similar to FIG. 4 with the valve fully open.

When the rod is released slowly, the process is reversed, allowing the chamber to be refilled with product while the can is still inverted. When the can is placed upright, the O-ring prevents liquid product from draining out of the chamber 30, thus maintaining the dispenser fully charged for the next dispensation. The successive filling and discharging phases are shown in FIGS. 3 to 5.

Figure 6A:
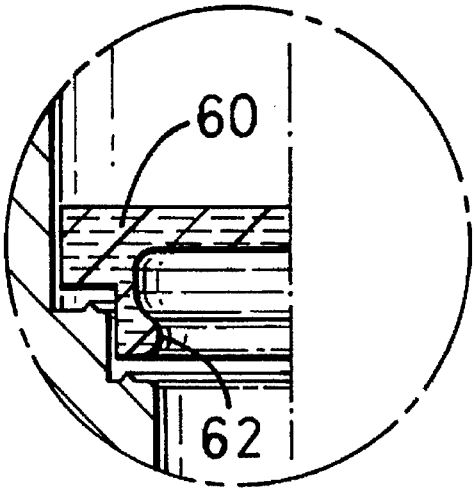
FIG. 6 shows three scrap sectional views, on a larger scale than the preceding figs, of alternative and different integral seals and supports.
Figure 6B:
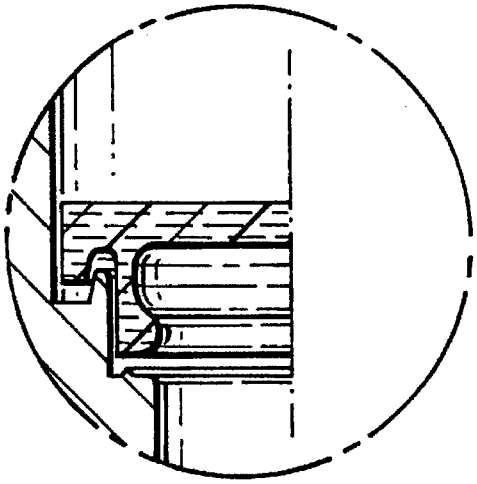
Figure 6C:
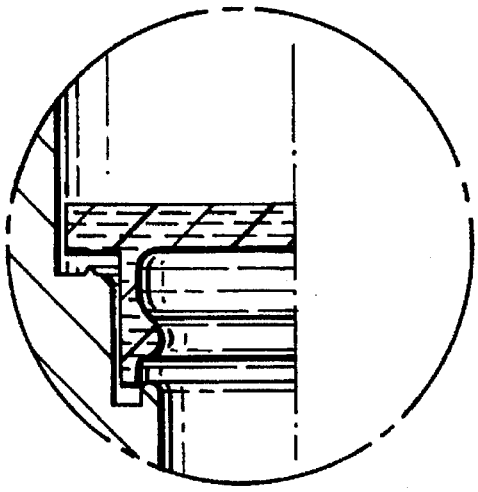
Figure 7:
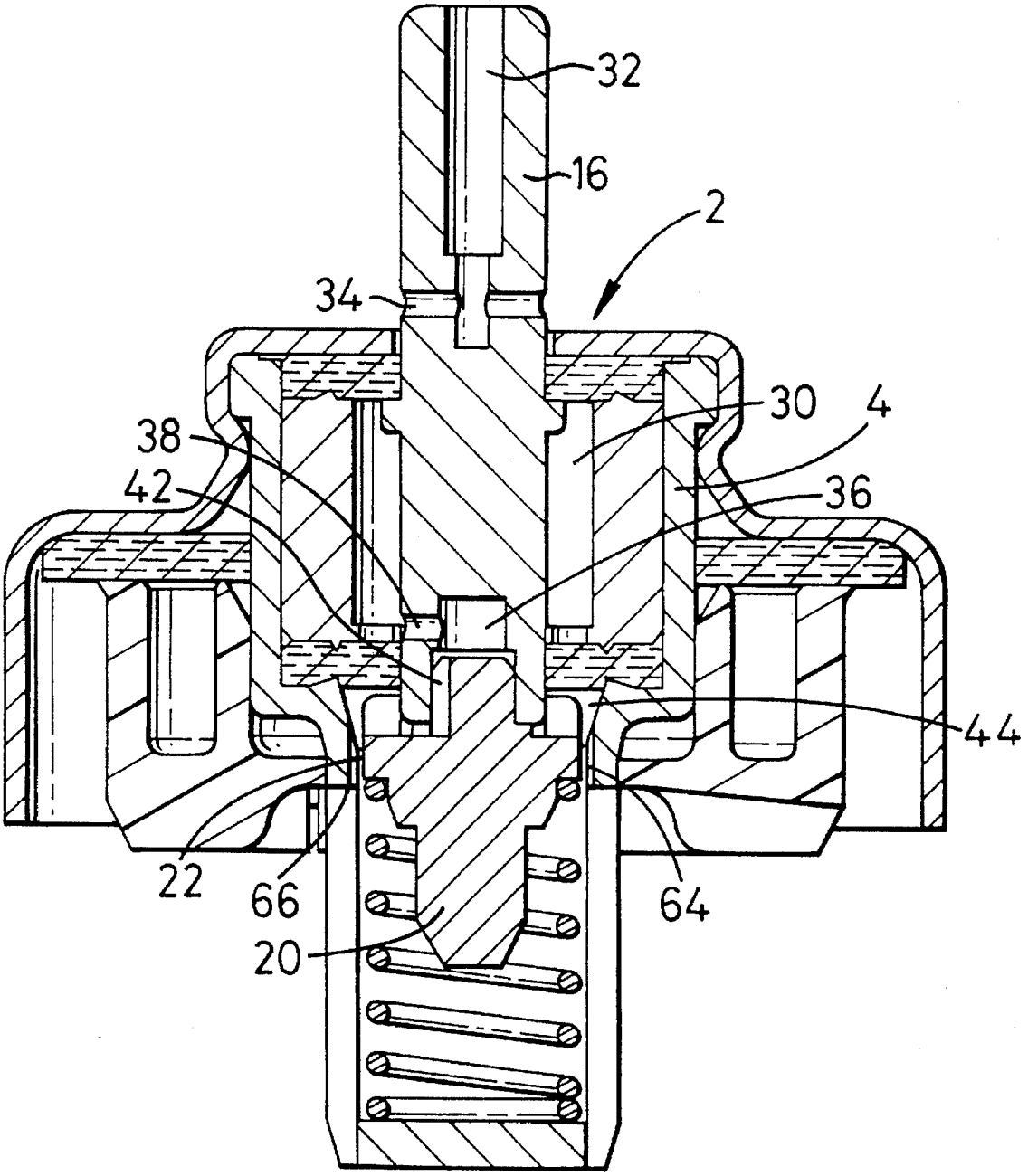
FIG. 7 is a sectional view of a second form of valve of the present invention.

FIG. 6 shows three alternative combined O-ring and sealing gaskets 60. Each can be substituted for the separate O-ring 48, ring 46 and gasket 14 shown in the preceding figs. Thus in each substitute member 60, the lobe 62 comes into sealing engagement with the surface 22 of the spring seat 20. This facilitates assembly. Each member 60 is moulded from a suitable plastics material, such as synthetic rubber.

That form of valve of the present invention shown in FIGS. 7 to 11 differs from the first embodiment in that the O-ring 48 is dispensed with. Instead, the body 4 is formed with a precisely-dimensioned inner cylindrical surface 64 which is positioned radially outwardly from the surface 22 of spring seat 20. The annular gap 66 between the two bodies is so narrow that the gap applies capillary forces to prevent liquid from flowing through the gap under only gravitational force. In addition, the passage 42 between chambers 36 and 44 is of such a small cross-sectional area (measuring, for example, 0.2×0.5 mm) that it too retains liquid in it by capillary forces. These forces have to be overcome to enable product to flow out of the container into the metering chamber 30 under the pressure of the propellant gas or vapor. The resulting impedance to fluid flow has to be taken into account when designing the valve, so that the desired volume of product is able to flow into the chamber 30 in the filling period.

FIG. 8 shows an intermediate stage of assembling the metering valve body to the container body 56. When some volatile product or propellant is put into the bottom of the container, and the valve body is moved towards the open mouth of the container, the vaporized product is able to purge the original air in the container through the annular gaps, indicated by arrows in FIG. 8, formed between parts of the valve body and the container. After the body is fully in position on the container, and the latter's flange has been crimped in place, the container is in gas-tight engagement with the body where it meets member 52, where its mouth meets gasket 50, and where the flange grips neck 57, as shown in FIG. 9.

Figure 9:
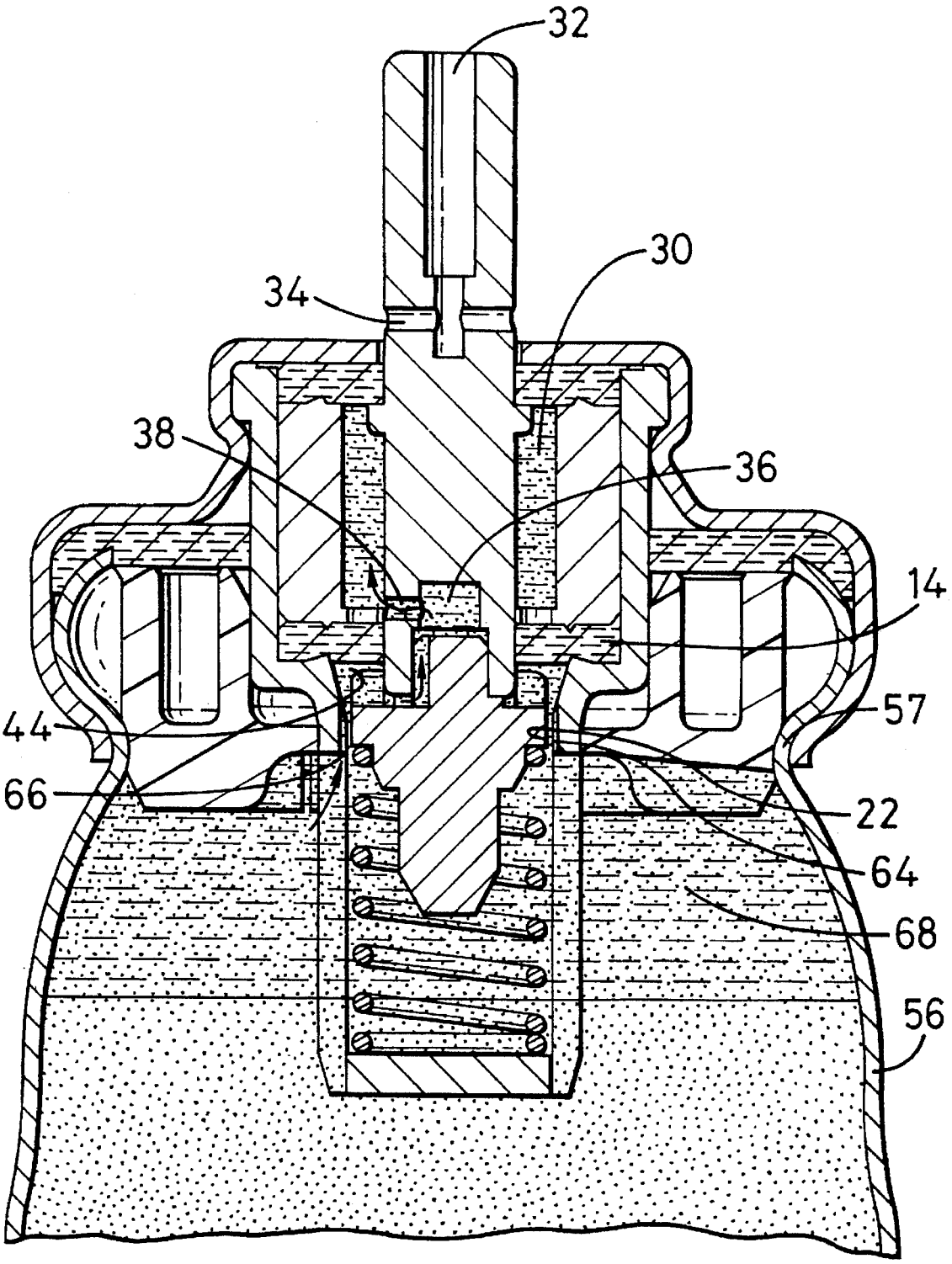
FIG. 9 is a view similar to FIG. 8 with the valve and container secured together, showing the path followed by the liquid filling the metering chamber.
Figure 10:
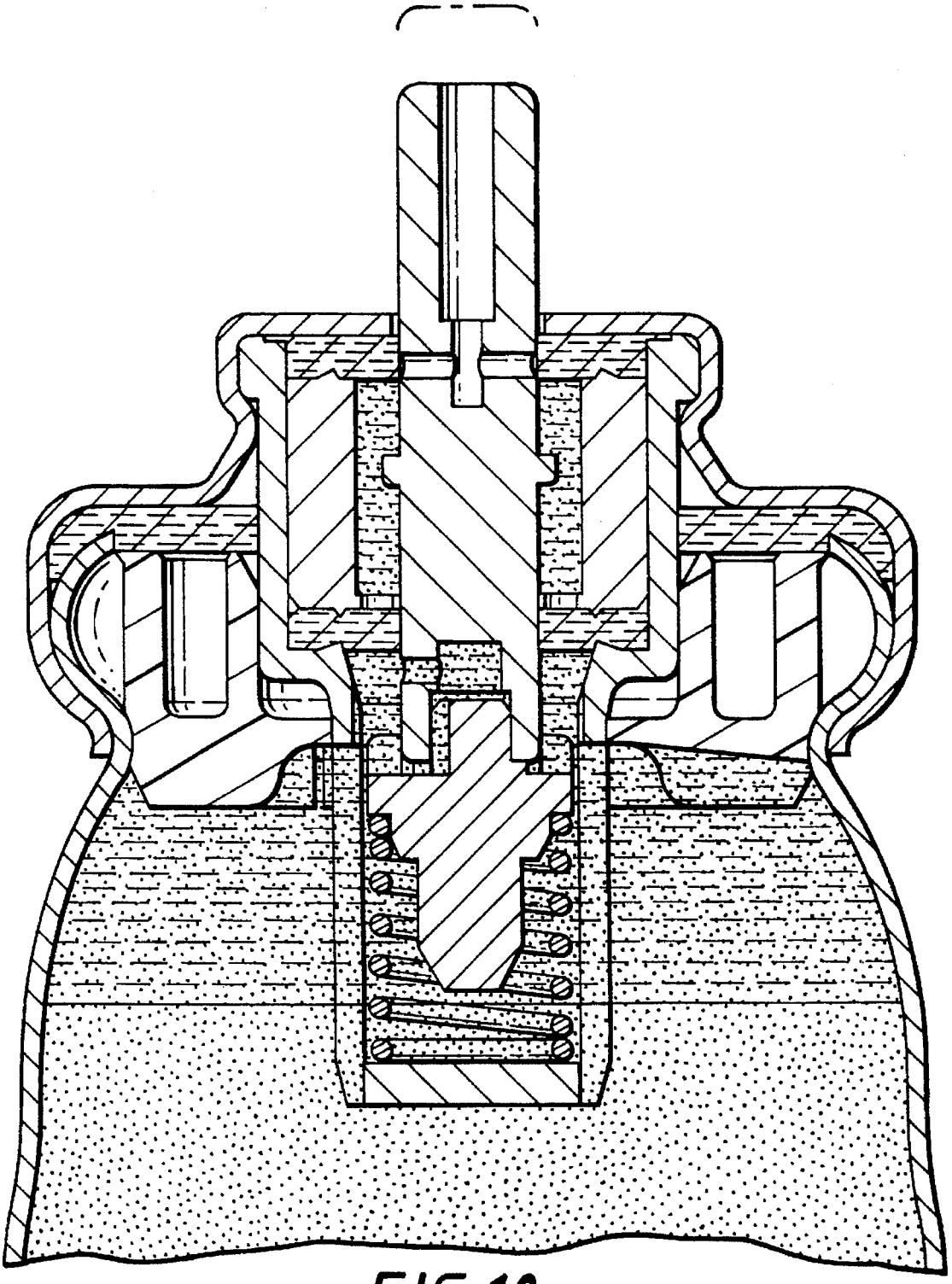
FIG. 10 is a view similar to FIG. 9 showing the valve partially open.
Figure 11:
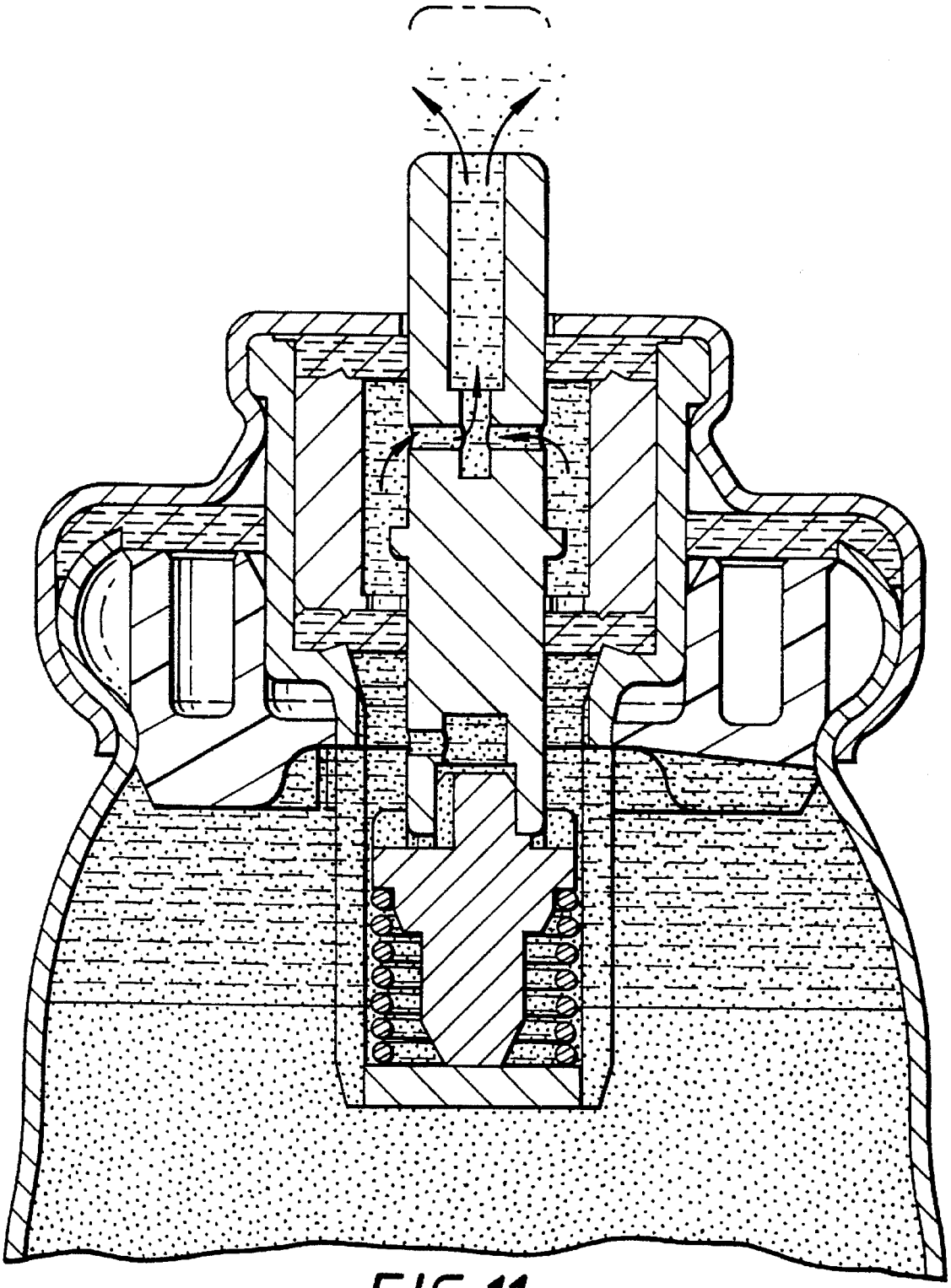
FIG. 11 is a view of the valve of FIG. 7 in its fully-open position.

As shown in FIG. 9, when the metering chamber 30 is at low pressure, as when its contents have been discharged through passage 32, fresh product is able to flow into it under the pressure in the can 56. When the valve rod has been depressed initially, the entry of any further liquid product is prevented by the gasket 14 blocking the passage 38. The later operation of the dispenser is obvious from FIGS. 10 and 11. With the can inverted, and the rod 16 released sufficiently slowly, first passage 34 becomes blocked off, and then passage 38 becomes opened to permit the metering chamber to be refilled. When the can is again upright, the chambers 30, 36 and 44, the passage 38, the capillary passage 42 and the annular gap 66 remain filled with liquid. Because of the capillary forces brought about by surface tension effects, gas or vapor in the ullage space 68 is not able to enter the gap 66 or passage 42 and displace the liquid, so that the metering chamber likewise remains fully charged until the can is inverted for the next dispensation of product.

It will thus be seen that the present invention provides a pressurized container of a liquid to be dispensed in doses per operation of fixed amounts after the can is inverted. Once the operating member is released and the can is replaced in its upright position, the metering chamber remains full despite the gravitational forces tending to make the liquid flow back into the can and be replaced by gas or vapor in the ullage space of the can.

I claim:

1. A metering valve adapted to be secured to an aerosol container in a fluid-tight manner, said valve comprising a metering chamber of fixed volume, a pair of spaced apart gaskets seated at opposite ends of said metering chamber, a valve rod extending through said gaskets in sealing engagement, a spring seat member movable with said valve rod, a biasing spring engaging said spring seat member, a valve body having part thereof circumscribing said spring seat member when in its valve-closed position, with said valve body and said spring seat member forming an annular passage through which liquid product to be dispensed flows en route to said metering chamber, said annular passage being so narrow that it forms a capillary passage which is able to hold liquid in said metering chamber by surface tension.

2. A metering valve as defined in claim 1 wherein said spring seat member includes at least one passage through which fluid flows to said metering chamber, said passage being of such small cross-sectional area that liquid is retained therein by capillary forces.

3. A metering valve as defined in claim 1 wherein said seat member has an annular surface and said annular passage is blocked by an annular seal engaging said cylindrical surface of said spring seat member when in its valve-closed position.

4. A metering valve as defined in claim 1 wherein said valve includes a flange adapted to be secured to the upper end of a container for the product to be dispensed.

* * * * *